United States Patent [19]

Wittse, Jr. et al.

[11] 4,444,669

[45] Apr. 24, 1984

[54] METHOD FOR CONTINUOUS MANUFACTURE OF HIGH DROPPING POINT LITHIUM COMPLEX SOAP GREASE

[75] Inventors: Arnold C. Wittse, Jr., Port Neches; Don A. Carley, Houston, both of Tex.; Richard L. Coleman, deceased, late of Beaumont, Tex., by Donald B. Moye, administrator

[73] Assignee: Texaco Inc., White Plains, N.Y.

[21] Appl. No.: 386,128

[22] Filed: Jun. 7, 1982

[51] Int. Cl.[3] ..... C10M 5/14

[52] U.S. Cl. ..... 252/41; 252/18; 252/25; 252/42.1

[58] Field of Search ..... 252/41, 18, 25, 42.1

[56] References Cited

U.S. PATENT DOCUMENTS

| | | | |
|---|---|---|---|
| 3,475,335 | 10/1969 | Greene et al. | 252/41 |
| 3,791,973 | 2/1974 | Gilani et al. | 252/41 |
| 4,297,227 | 10/1981 | Witte et al. | 252/25 |

*Primary Examiner*—Jacqueline V. Howard

*Attorney, Agent, or Firm*—Robert A. Kulason; James J. O'Loughlin; Alan M. Kamel

[57] ABSTRACT

A continuous process for the preparation of high dropping point i.e. above 400° F. lithium complex soap thickened grease composition comprising the steps of continuously saponifying a hydroxy $C_2$–$C_{24}$ monocarboxylic acid and a $C_2$ to $C_{12}$ dicarboxylic acid with a lithium base in a lubricating oil substrate and then continuously dehydrating the mixture.

30 Claims, No Drawings

METHOD FOR CONTINUOUS MANUFACTURE OF HIGH DROPPING POINT LITHIUM COMPLEX SOAP GREASE

BACKGROUND OF THE INVENTION

1. Field of the Invention

This invention relates to a method for the manufacture of a high dropping point lithium complex soap thickened grease. More particularly, it relates to a method for carrying out the preparation of a high dropping point lithium complex soap thickened grease in a continuous operation including a continuous direct saponification step and a continuous dehydration step.

A lithium complex soap grease is one in which a mixture of lithium soaps of hydroxy monocarboxylic fatty acids and dicarboxylic fatty acids are employed as the thickener for the grease. The process of making a lithium complex soap grease having a high dropping point, i.e. over 500° F., is a highly refined art. Small variations in the process are critical and can determine whether the grease resulting from the process has a high dropping point or not. For instance, the direct saponification of fatty acids by a lithium base has resulted in a lithium complex soap grease having a low dropping point, i.e. below 400° F., and a poor appearance. Apparently, this is caused by the non-uniform dispersion of the soap of the dicarboxylic acid in the oil. Many prior art batch or non-continuous processes for preparing a high dropping point lithium complex soap grease employed alternative procedures to direct saponification.

2. Description of the Prior Art

U.S. Pat. No. 2,898,296 discloses a batch process for making high dropping point lithium complex grease which requires that the dicarboxylic fatty acid be converted to an ester prior to reacting it with lithium hydroxide.

U.S. Pat. No. 2,940,930, discloses a batch process for manufacturing high dropping point lithium complex soap grease which requires that a polyhydric alcohol or glycol be added to the monobasic and dibasic acid mixture before lithium hydroxide is reacted with the mixture.

U.S. Pat. No. 3,791,973 discloses a batch process for preparing a high dropping point lithium complex soap grease which requires the separate formation of the lithium soap of the hydroxy fatty acid and the lithium soap of the aliphatic dicarboxylic acid.

U.S. Pat. No. 3,689,242, discloses a batch process for preparing a high dropping point lithium complex soap grease which requires two distinct heating stages after saponification.

The novel process of the instant invention employs a continuous heating step to prepare a high dropping point lithium complex soap grease.

Continuous processes for manufacturing soap thickened grease compositions are disclosed in U.S. Pat. No. 3,475,335 and U.S. Pat. No. 4,297,227 but, no high dropping point grease have been made by these continuous processes.

The concurrently filed and copending application Ser. No. 385,744 discloses a batch process for preparing a high dropping point lithium complex soap grease which employs direct saponification requiring controlled alkali addition and only one heating stage after saponification.

In contrast to the prior art, a novel continuous process for making a lithium complex soap grease composition having a high dropping point i.e. above 400° F., has now been discovered.

SUMMARY OF THE INVENTION

Now, according to the present invention we have discovered a method for producing a high dropping point i.e. above 400° F. lithium complex soap grease product via a continuous grease manufacturing process employing a continuous direct saponification step and a continuous heating step.

A hydroxy $C_{12}$–$C_{24}$ monocarboxylic acid and a $C_2$ to $C_{12}$ dicarboxylic acid in a 10:1 to 0.5:1 mole ratio range and lithium base along with lubricating oil are continuously introduced into a saponification zone maintained at from 250° F. to 350° F., at a pressure sufficient to maintain the water in a liquid state and under turbulent saponification conditions. The grease is continuously dehydrated at from about 325° F. to about 425° F. under a pressure ranging from atmospheric pressure to 10 inches of mercury vacumn. Any additional oil required is added thereto to form a high dropping point lithium complex soap grease of the desired grade. The process also contemplates cooling and finishing steps which may be carried out by adding additional lubricating oil at a lower temperature than the grease mixture or by passing the grease mixture through a cooler as well as steps for shearing of the grease mixture within a suitable temperature range either during or after the cooling step.

DETAILED DESCRIPTION OF THE INVENTION

The high dropping point lithium complex soap grease making process of this invention comprises saponification, dehydration and soap conditioning steps carried out in a continuous manner with recycling of the grease mixture through a shear valve during the soap conditioning step. In the preferred embodiment, the saponification reaction is conducted while employing a high degree of turbulence or mixing during the reaction. The process also includes cooling and finishing steps which may be carried out by adding additional lubricating oil at a lower temperature than the grease mixture or by passing the grease mixture through a cooler or a combination of these two steps together with shearing of the grease mixture within a suitable temperature range either during or after the cooling step.

The base employed in the saponification may be an hydroxide or other suitable basic reacting compound of lithium ordinarily employed as a metal component of the soap in the preparation of lubricating greases. It is preferably a lithium oxide, hydroxide, or carbonate and most preferably lithium hydroxide. Most preferably, the lithium base is an approximately 10% by weight aqueous lithium hydroxide solution and is added in the required stoichiometric amount plus a 0.2 to 0.05 weight percent and usually a 0.10 weight percent excess along with a suitable lubricating base oil sufficient to give the mixture a total theoretical soap concentration of from about 10 weight percent up to about 40 weight percent, preferably from 18 to 30 weight percent and most preferably about 20 weight percent.

The saponifiable materials in the manufacture of these grease preparations comprise a mixture of a $C_{12}$ to $C_{24}$ hydroxy fatty acid and a $C_2$ to $C_{12}$ dicarboxylic fatty acid and most preferably a mixture 12-hydroxy stearic acid and azelaic acid. The mole ratio of hydroxy fatty acid to dicarboxylic acid ranging from about a 10:1 to about a 0.5:1 respectively is considered critical. Acid ratios within this prescribed range give lithium complex soap greases having dropping points above 400° F. An even more preferred mole ratio range of hydroxy monocarboxylic fatty acid to dicarboxylic acid, namely from 3:1 to 0.5:1, will yield a grease having a surprisingly high dropping point above 500° F. The most preferred mole ratio of hydroxy fatty acid to dicarboxylic acid is approximately 1.6:1.

The oleaginous liquids employed in these greases may be any suitable oils having lubricating characteristics, including the conventional mineral lubricating oils, synthetic oils obtained by various refining processes such as cracking and polymerization and other synthetic oleaginous compounds such as high molecular weight ethers and esters. The dicarboxylic acid esters, such as di-2-ethylhexyl sebacate, di(secondary amyl) sebacate, di-2-ethylhexyl azelate, diisooctyl adipate, etc., comprise a particularly suitable class of synthetic oils and may be employed either as the sole oleaginous component of the grease or in combination with other synthetic oils or mineral oils. Suitable mineral oils for use in these greases are those having viscosities in the range from about 100 to about 8000 seconds Saybolt Universal at 100° F., which may be blends of low and high viscosity oils. They may be either naphthenic or paraffinic in type, or blends of two or more oils of these different types.

The apparatus which can be used to prepare the high dropping point lithium complex soap grease according to the process of the instant invention is described in U.S. Pat. No. 3,475,335, all of which is hereby incorporated by reference into the instant application.

In carrying out the process of the invention, the saponification zone is maintained at an elevated temperature and a pressure at least sufficient to maintain the water present in the saponification mixture in the liquid phase. The dehydration zone is operated at an elevated temperature below the melting point of the lithium complex soap and under a substantially lower pressure than the saponification zone so that the major portion of the water is flashed off when the grease mixture enters the dehydration zone. Any water remaining is removed during recycling of the grease mixture through the shear valve, which in effect subjects the grease mixture to a continuous flashing operation by pressure release of the recycle stream through the valve. The recycling is preferably carried out at a rapid rate, such that the grease mixture is subjected to multiple passes through the shear valve operated with at least a substantial pressure drop during the residence time of the grease mixture within the zone. Cooling of the grease mixture is carried out by adding a lubricating oil at a substantially lower temperature than the grease mixture, and, advantageously in some cases by recycling of the grease mixture through a cooler. It is also advantageous or desirable at this stage to recycle the grease mixture through a shearing means during or after cooling, generally employing a temperature in a range from about 180° F. to 250° F. temperature range.

A high dropping point lithium complex grease of excellent quality is obtained in the above manner in a good yield and in a greatly reduced manufacturing time as compared to known processes. This is believed due to the effect upon the soap fiber development of the recycle shearing during the dehydration and the soap conditioning steps, and also to the combined effect of this shearing with the effect of carrying out the saponification under turbulent conditions which provides a grease mixture wherein the soap molecules or micelles are present in a highly dispersed state.

In carrying out the grease making process of this invention the mixture of hydroxy and dicarboxylic fatty acids pass at a controlled rate and a solution of slurry of lithium base, preferably lithium hydroxide, passes at a controlled rate into a reaction zone along with sufficient lubricating oil to give an overall soap concentration of 10–40 wt. % in the reaction zone. When the saponification is carried out employing a slurry of lithium base in oil, it is generally desirable to introduce a small amount of water or steam into the reaction zone in order to promote the reaction. The reaction mixture in the reaction zone is maintained under superatmospheric pressure at least sufficient to maintain the water present for producing the reaction in the liquid phase and at an elevated temperature sufficient to obtain a rapid reaction between the lithium base and the mixture of hydroxy and dicarboxylic fatty acids. Suitable reaction conditions include broadly a pressure in the range from about 45 to about 200 lbs. per square inch gauge and a temperature from about 250° F. to about 350° F. The preferred conditions include a pressure in the range from about 65 lbs. per square inch to about 120 lbs. per square inch and a temperature in the range from about 280° F. to about 330° F.

The reaction mixture is introduced into the reaction zone under conditions or at a velocity which promotes a turbulent flow with intensive mixing within the zone. With special advantage, the reactants are mixed at a velocity resulting in highly turbulent flow, preferably at a velocity resulting in a Reynolds number in the range from about 4,000 to about 100,000. Recycle flow rates required to obtain the desired degree of turbulence are generally within range from about 0.6 to about 12.0 cubic feet per minute per square inch of reactor cross-section. The mixture is recycled in the reaction zone at a flow rate which gives a recycle ratio i.e. rate at which the grease mixture is being pumped through recycle line to rate at which grease mixture is being pumped into the reaction zone, of at least about 4:1. Somewhat lower or higher recycling ratios may be employed in some cases, such as the recycle ratio as low as about 1:1 and as high as 20:1 although usually the recycle ratio ranges from 8:1 to 10:1.

The lithium complex saponification products obtained by this process are especially suitable for use in the subsequent grease making steps because of the readiness with which they accept additional lubricating oil and because of the short soap conditioning period they require as compared to grease mixtures obtained under other saponification conditions. An unusual property of the lithium complex soap of the invention is shown by the fact that it forms a grease-like product immediately upon cooling when the saponification mixture is blended with a lubricating oil. This surprising result is presumably due to the severe shearing to which the reaction mixture is subjected when it is passed through a relatively small diameter of the recycle tube under the turbulent flow conditions in the reaction zone.

The product stream from the reaction zone is directed into a dehydration zone which may be jacketed or otherwise provided with indirect heating or cooling means. The grease mixture in the dehydration zone is maintained at a temperature ranging from about 325° F. to about 425° F. with a preferred temperature range of 350° F. to 400° F. and at a pressure substantially lower than that in the reaction zone, very suitably from atmospheric pressure to about under a partial vacuum of about 10 inches of mercury.

During its residence in the dehydration zone the grease mixture is recycled continuously through a shear valve, suitably a gate valve, set in a partially closed position so as to give a pressure drop to about 10–150 lbs. per square inch, and preferably about 30–120 lbs. per square inch across the valve and most preferably about 60 psig. The recycling is preferably carried out at a rapid rate, such that the volume of recycled grease mixture is from 5 to 40 and preferably 8 to 30 times the total average volume of grease mixture within the dehydration zone (5 to 40 and preferably 8 to 30 turnovers) within one minute. The grease residence time in the dehydration zone should be sufficient to obtain substantially complete dehydration of the mixture. The residence time of the grease mixture in the dehydration zone will usually be from a few to about 60 minutes, although somewhat shorter or longer periods may be employed. In carrying out the process under the preferred conditions, the residence time in the dehydration zone may be from 3 minutes up to about 20 minutes, and preferably 15 to 20 minutes, depending upon factors such as temperature, soap concentration of the grease mixture and character of the lubricating oil.

In a preferred embodiment of the invention the mixture from the reaction zone is preheated briefly at a temperature of about 250° to 350° F. and a pressure of about 10 to 40 psig prior to entering the dehydration zone. The saponification products of complex soaps contain an unusually large amount of water resulting from the greater number of carboxylic acid moieties present in the acid reactant mixture. Thus the preheating step is advantageous because it reduces the amount of heat and/or residence time of the mixture in the dehydration zone which might otherwise be required to dehydrate the complex saponification products mixture.

Additional lubricating oil may be added to the grease mixture at various steps in the process in order to obtain the desired soap concentration or to assist in heating or cooling the grease mixture. This additional lubricating oil keeps the grease mixture fluid enough for circulating through the recycle lines. It may also be employed as a means of heating the grease mixture in order to increase the water removal when the grease mixture is flashed into the dehydration zone.

Additionally or alternatively, to the lubricating oil addition in the above manner, lubricating oil may be added to the grease mixture during the soap conditioning step. It may pass into the recycle stream of the grease mixture as a means of aiding in the recycling when a heavy grease mixture is being circulated, and also as a means of increasing the rate of dehydration by increasing the temperature of the recycle stream in some cases.

Indirect heating or cooling of the grease lithium complex mixture in the dehydration zone may be employed either in addition or alternatively to the heating or cooling obtained by oil addition as described above. The indirect heating or cooling may be obtained very conveniently by employing a jacketed vessel for the dehydration zone and pass in a heat exchange fluid through the vessel jacket. Very advantageously in some cases the indirect heating or cooling is applied to the recycle stream of the grease mixture by passing the grease mixture through the heat exchanger. It is, for example, particularly advantageous in some case to cool the recycle stream in this manner in order to obtain an increased effect in the shearing step due to the more viscous grease mixture obtained by the cooling.

A stream of substantially dehydrated grease mixture is continuously withdrawn from the recycle stream. Additional lubricating oil may be added to the grease mixture at this time. It is ordinarily preferable to add this oil at a temperature substantially lower than that of the grease mixture, very suitably in some cases at ambient temperature. However, in many cases it is advantageous to preheat the oil, particularly where a high rate of oil addition is employed or where it is desirable to employ a slower cooling rate. The oil is added at the rate necessary to give the desired consistency to the grease product.

The additional oil added to the grease mixture may amount to as much as about 75% by weight of the total oil in the finished grease. It is ordinarily preferable to carry out the grease preparation with about 50% by weight of the total oil contained in the grease added in this manner at a temperature at least about 175° F. lower than the temperature of the grease mixture at this stage in the process.

At this point the grease mixture may be sheared by means of a shearing valve such as a gate valve which may be operated with a substantial pressure drop. A differential shear pressure of 30 to 120 psig is used with a preferred shear pressure of 60 psig. Also where it is desirable to obtain additional cooling the grease mixture may pass through a cooler. Recycling of the grease mixture may be employed in order to obtain multiple passes through the shearing valve and cooler. Recycling of the grease should take place at a rate to maintain a minimum recycle ratio of 4.5:1. Additional lubricating oil at the same or lower temperature may be added to the stream of grease mixture alternatively or in addition to the lubricating oil added as described above. When additional oil is added in this manner it becomes mixed with the grease mixture as the combined steam passes through the shear valve. The stream of grease mixture containing oil added in this manner may pass through additional shearing means if desired. The desired temperature of the lithium complex grease product should be low enough for safe handling and packaging and high enough to permit pumping of the product without excessive pressure drop over the length of the pumping line. Such a desired temperature range is generally from about 180° F. to about 250° F.

Any additives employed in the lithium complex grease are preferably introduced into the grease mixture during the cooling ordinarily where the grease mixture is below about 250° F. When the grease mixture at this point is not at a suitably low temperature the additives may be added at some later point in the cooling and finishing section.

In the production of greases from synthetic oils which are hydrolyzed under the saponification conditions, the saponification is preferably carried out in the absence of any lubricating oil or of a minor amount of a lubricating oil which is substantially inert under the saponification conditions such as a mineral oil and the synthetic oil added at later stages of the grease making process as described hereinabove.

The following examples are illustrative of lubricating grease preparations carried out in accordance with this invention.

EXAMPLE 1

Lithium 12-Hydroxy Stearate-Azelate Mixture Soap Thickened Grease

The apparatus employed in the preparation comprised a coil reactor, a dehydrator and a cooler, with auxiliary equipment for circulating the grease mixture through each of these zones as well as for introducing reactants and additional lubricating oil, moving the grease mixture between the zones and withdrawing a product stream. The reactor consisted of a 21-foot section of ¾ inch Schedule 40 black iron pipe (0.824 inch inside diameter) formed into a coil having a 4 inch inside diameter and mounted in a 3 foot section of 12 inch pipe serving as a steam chamber. The recycle line on the reaction zone comprised 9 feet of ¾ inch pipe containing a recycle pump, which was a Viking Rotary heavy duty pump having a capacity of 18 gallons per minute at 1200 revolutions per minute. The capacity of the reactor and recycle line including the pump was 0.12 cubic foot. The dehydrator comprised a 3 foot section of 10 inch Schedule 40 black iron pipe with a blind flange and a bell cap on the ends and electrically heated by a wrapping of resistance wire on the outside. The recycle line on the dehydrator consisted of a 5 foot section of 0.824 inch inside diameter pipe containing a recycle of the same type as that employed in the recycle line on the reactor and a Jordan valve. The dehydrator was connected at the top by a 2.067 inch inside diameter pipe to a vacuum jet with a condenser. The reactor and dehydrator were connected by a 0.824 inch inside diameter pipe containing a Fulflo valve.

The following materials were employed in the grease preparation. The fatty acid mixture employed was a mixture of 67.5 weight percent 12-hydroxy stearic acid and 32.5 weight percent azelaic acid. The C-12 hydroxy stearic acid employed was a commercial product having a saponification number of 186, a neutralization number of 177 and Iodine number of 3. The azelaic acid had a saponification number of 590, a neutralization number of 575 and an Iodine number of 9.

The mineral oil employed was a paraffinic refined dewaxed oil having a Saybolt Universal viscosity at 100° F. of about 1130 seconds with the following characteristics: Gravity, API, 24.4; Flask COC, 450° F.; Pour, 20° F.; The saponifying agent was 10 weight percent solution of lithium hydroxide in water.

A mixture consisting of 67.5 weight percent of 12-hydroxy stearic acid and 32.5 weight percent of melted azelaic acid was preheated to 200° F. and was charged into the reaction zone at a rate of 24 lbs per hour together with a ten percent aqueous lithium hydroxide solution at room temperature charged at a rate of 34 lbs per hour and a sufficient amount of lubricating oil to produce a grease concentration comprising about 14 weight percent soap and 67 weight percent of lubricating oil in the reaction zone and 19 wt. % water. The reaction mixture was heated to 330° F. and reacted at a pressure of about 100 lbs. per square inch. The reaction mixture was recycled in the reactor at a rate of 1.6 gallons per minute, which corresponded to a recycle ratio of about 4.4:1. The product stream was then introduced into a transfer zone where it was briefly heated at about 270° F. and 30 p.s.i.g. The product stream was then introduced into the dehydrator where it was maintained at 370° F. and at a pressure of 0 p.s.i.g.. The grease mixture was recycled from the bottom to the top of the dehydration zone at a rate of 6 gallons per minute giving a recycle ratio of 20:1 by pumping the mixture through the recycle line and through a shear valve operated with a pressure drop of about 60 lbs per square inch. The grease mixture was maintained in the dehydration zone for an average residence time of about 47 minutes, during which time it was recirculated through the recycle line and shear valve about 60 times.

The dehydrated product stream was withdrawn from the dehydrator and cooled by the addition of lubricating oil at a lower temperature and recycled through the shear valve with a recycle rate of 2.3 gallons per minute, resulting in a recycle ratio of 5:1. Circulation through the cooler was not employed in this preparation. The additional oil at 100 ° F. was introduced into the stream of grease mixture at a rate of 54 pounds per hour. The shear valve in the recycle line was set to give a pressure drop of 60 pounds per square inch.

The grease product withdrawn from the finishing section had a soap content of 12.9 weight percent. It was a smooth textured, slightly stringy and glossy grease composition. The following analyses and test results were obtained:

| Tests: | |
|---|---|
| Penetration, ASTM, at 77° F. | |
| Unworked | 271 |
| Worked | 302 |
| Worked 10,000 strokes | 348 |
| Dropping point ASTM, °F. (D566) | 500+ |

EXAMPLE 2

Lithium 12-Hydroxy Stearate-Azelate Mixture Soap Thickened Grease

The apparatus employed in the preparation was the same as in Example 1.

The fatty acids and the mineral oil employed was also the same as in Example 1.

A mixture consisting of 67.5 weight percent of 12-hydroxy stearic acid and 32.5 weight percent of melted azelaic acid was preheated to 200° F. and was charged into the reaction zone at a rate of 26 lbs per hour together with a ten percent aqueous lithium hydroxide solution at room temperature charged at a rate of 37 lbs per hour and a sufficient amount of lubricating oil to produce a grease concentration comprising about 14 weight percent soap and 67 weight percent of lubricating oil in the reaction zone and 19 wt. % water. The reaction mixture was heated to 340° F. and reacted at a pressure of about 120 lbs. per square inch. The reaction mixture was recycled in the reactor at a rate of 1.5 gallons per minute, which corresponded to a recycle ratio of about 4:1. The product having a soap content of about 14 percent was then introduced into a transfer zone where it was briefly heated at about 270° F. and 30 p.s.i.g. The product stream was then introduced into the dehydrator where it was maintained at 370° F. and at a pressure of 0 p.s.i.g.. The grease mixture was recycled from the bottom to the top of the dehydration zone at a rate of 4.8 gallons per minute giving a recycle ratio of 14:1 by pumping the mixture through the recycle line and through a shear valve operated with a pressure drop of about 60 lbs per square inch. The grease mixture was maintained in the dehydration zone for an average residence time of about 47 minutes, during which time it was recirculated through the recycle line and shear valve about 60 times.

The dehydrated product stream was withdrawn from the dehydrator and cooled by the addition of lubricating oil at a lower temperature and recycled through the shear valve with a recycle rate of 2.5 gallons per minute, resulting in a recycle ratio of 6:1. Circulation through the cooler was not employed in this preparation. The additional oil at 100 ° F. was introduced into the stream of grease mixture at a rate of 85 pounds per hour. The shear valve in the recycle line was set to give a pressure drop of 60 pounds per square inch.

The grease product withdrawn from the finishing section had a soap content of 14 weight percent. It was a smooth textured, slightly stringy and glossy grease composition. The following analyses and test results were obtained:

| Tests: | |
|---|---|
| Penetration, ASTM, at 77° F. | |
| Unworked | 294 |
| Worked | 337 |
| Worked 10,000 strokes | 365 |
| Dropping point ASTM, °F. (D566) | 500+ |
| Wheelbearing leakage, g (D 1268) | 4.0 |

The forgoing data demonstrates that a high quality high dropping poing lithium complex soap grease composition was produced by the continuous process of this invention.

It will be appreciated that many variations and modifications of the above process will occur to those skilled in the art. It is intended that all such variations and modifications be considered as included herein and the only limitations of the present invention are those incorporated within the appended claims.

We claim:

1. A continuous process for preparing a high dropping point lithium complex soap grease which comprises continuously introducing a reaction mixture, comprising a $C_2$ to $C_{12}$ dicarboxylic acid and a $C_{12}$ to $C_{24}$ hydroxy fatty acid in a mole ratio ranging from about 1:10 to 1:0.5 respectively, a lithium base and a lubricating oil into a reaction zone wherein said mixture is heated to a temperature from about 250°to 350° F. under a pressure sufficient to maintain the water in the liquid state and under turbulent mixing conditions sufficient to obtain adequate contact between the reactants for a period of time sufficient to obtain a substantially complete reaction to form a lithium complex soap, continuously withdrawing a product stream from said reaction zone, introducing additional lubricating oil into said product stream to give said grease mixture enough fluidity for circulation, continuously introducing said grease mixture into a dehydration zone maintained at a temperature ranging from about 325° to 425° F. under a pressure ranging from about atmospheric to about 10 inches of mercury vacumn and circulating said mixture from the bottom to the top of said dehydration zone through a recycle line and a shear valve having a pressure drop across said valve of from 10 to 150 lbs. per square inch continuously withdrawing a product stream from said dehydration zone and cooling said product stream to provide a finished grease composition.

2. A process according to claim 1 wherein the temperature in the reaction zone ranges from about 280° F. to about 330° F.

3. The process according to claim 1 wherein the pressure in the reaction zone ranges from about 45 psig to about 150 psig.

4. A process according to claim 1 wherein the pressure in the reaction zone ranges from about 65 psig to about 120 psig.

5. A process according to claim 1 wherein the temperature in the dehydration zone ranges from about 350° F. to about 400° F.

6. A process according to claim 1 wherein the said lithium base is selected from the class consisting of lithium oxides, lithium hydroxides and lithium carbonates.

7. A process according to claim 1 wherein the mole ratio of dicarboxylic acid to hydroxy monocarboxylic acid is approximately 1:3 to 1:0.5.

8. A process according to claim 1 wherein the mole ratio of dicarboxylic acid to hydroxy monocarboxylic acid is approximately 1:1.6.

9. The process according to claim 1 wherein the dicarboxylic acid is azelaic acid.

10. A process according to claim 1 wherein the hydroxy fatty acid is 12-hydroxy stearic acid.

11. The process according to claim 1 wherein the lithium base is approximately 10% by weight aqueous lithium hydroxide solution.

12. A process according to claim 1 wherein the lithium base is approximately 10% by weight aqueous lithium hydroxide solution and is added in the required stoichiometric amount plus a 0.2 to 0.05 weight percent excess along with a suitable lubricating base oil sufficient to give total theoretical soap concentration of from about 10 weight percent up to about 40 weight percent.

13. A process according to claim 12 wherein the lithium hydroxide solution is added in the required stoichiometric amount plus a 0.1 excess.

14. A process according to claim 1 wherein sufficient turbulence is maintained in the reaction zone by recirculating the product in the reaction zone.

15. A process according to claim 14 wherein the product in the reaction zone is recycled at a recycle rate ratio of at least about 4:1.

16. A process according to claim 1 wherein dehydration is partially accomplished by reduction of pressure on the reaction stream between the reaction zone and the dehydration zone.

17. A process according to claim 1 wherein the lithium complex soap grease mixture is briefly heated prior to entering the dehydration zone at a temperature of from 250° to 350° F. and at a pressure of from 10 to 40 psig.

18. A process according to claim 1 wherein the recirculation rate in the dehydration zone is such that a recycle rate ratio of at least 10:1 is maintained.

19. A process according to claim 1 wherein the recirculation rate in the dehydration zone is such that the volume of recycled grease mixture during the residence time of said mixture within said dehydration zone equals at least 5 to 40 times the total average volume of said mixture within said zone.

20. A process according to claim 1 wherein the recirculation rate in the dehydration zone is such that the volume of recycled grease mixture during the residence time of said mixture within said dehydration zone equals at least 5 to 30 times the total average volume of said mixture within said zone.

21. A process according to claim 1 wherein the shear valve pressure drop in the dehydration zone is between about of 10 and 120 psig.

22. A process according to claim 1 wherein the shear valve pressure drop in the dehydration zone is about 30 psig.

23. A process according to claim 1 wherein the product stream from the dehydration zone is cooled by adding the remaining amount of lubricating oil to it.

24. A process according to claim 22 wherein the remaining amount of lubricating oil is added to the product stream withdrawn from the dehydration zone at a rate necessary to give the desired consistency to the grease.

25. A process according to claim 1 wherein any additives that are required are introduced into the grease mixture after withdrawing it from the dehydration zone.

26. A process according to claim 1 wherein the temperature of the final grease product is low enough for safe handling and packaging and high enough to permit pumping of the product without excessive pressure drop over the length of the pumping line.

27. A process according to claim 1 wherein the product temperature is between about 180° and about 250° F.

28. A process according to claim 17 wherein the grease mixture is sheared through a valve having a pressure difference across it of from about 30 to about 120 psig.

29. A process according to the claim 26 wherein the pressure difference is approximately 100 psig.

30. A process according to claim 1 wherein as the grease mixture cools it is recycled through a shearing valve at a rate such as to maintain a minimum recycle ratio of 4.5 to 1.

* * * * *